US005860787A

United States Patent [19]

Richards

[11] Patent Number: 5,860,787

[45] Date of Patent: Jan. 19, 1999

[54] ROTOR BLADE AXIAL RETENTION ASSEMBLY

[75] Inventor: Martyn Richards, Burton on Trent, England

[73] Assignee: Rolls-Royce plc, London, England

[21] Appl. No.: 840,912

[22] Filed: Apr. 18, 1997

[30] Foreign Application Priority Data

May 17, 1996 [GB] United Kingdom ..... 9610400

[51] Int. Cl.[6] ..... F01D 5/32

[52] U.S. Cl. ..... 416/220 R

[58] Field of Search ..... 416/219 R, 220 R, 416/221, 215, 216, 218

[56] References Cited

U.S. PATENT DOCUMENTS

| | | | |
|---|---|---|---|
| 2,801,074 | 7/1957 | Brown | 416/221 |
| 3,986,779 | 10/1976 | Beckershoff | 416/221 |
| 4,527,952 | 7/1985 | Forestier et al. . | |
| 5,044,886 | 9/1991 | Stenneler | 416/215 |
| 5,151,013 | 9/1992 | Moore . | |

FOREIGN PATENT DOCUMENTS

| | | | |
|---|---|---|---|
| 2344710 | 10/1977 | France | 416/221 |
| 313027 | 4/1956 | Switzerland | 416/220 R |

*Primary Examiner*—Christopher Verdier
*Attorney, Agent, or Firm*—W. Warren Taltavull; Farkas & Manelli PLLC

[57] ABSTRACT

A bladed rotor has blades fitted in grooves around its rim. The blades are prevented from making significant movement lengthways of their grooves by abutment members which are so formed as to enable fitting and removal without the use of special tooling.

2 Claims, 1 Drawing Sheet

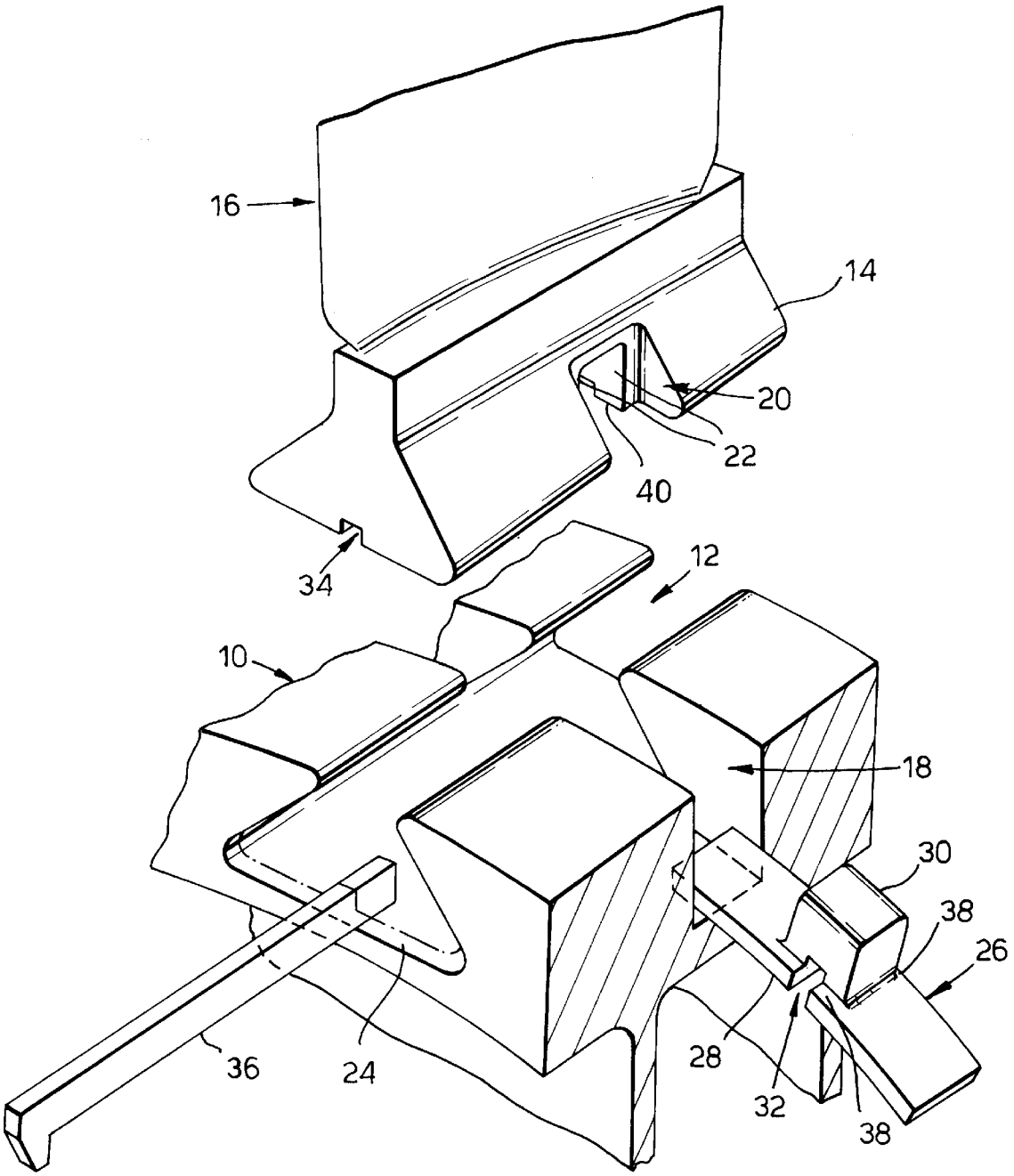
16
14
20
22
40
34
12
10
18
30
38
26
36
24
28
32
38

ROTOR BLADE AXIAL RETENTION ASSEMBLY

FIELD OF INVENTION

The present invention relates to a rotor for a gas turbine engine, which may include a ducted fan, the rotor supporting a peripheral row of blades.

BACKGROUND OF THE INVENTION

The rotor may comprise the fan.

During operation of an associated engine, the rotor blades undergo fluid loading, which causes them to attempt to move in a direction axially of the engine. It follows that they have to be restrained. However, the manner of restraint must be such as to facilitate easy removal, preferably, of individual blades for the purpose of repair or substitution, without the need for use of special tooling.

Whilst it is known to restrain members against movement axially of an associated engine, where the members are located in grooves in the rim portion of a rotor, those members do not have blades projecting from them. An example of such an arrangement is described and illustrated in British patent specification 1,514,724. In that specification a rotor has a peripheral groove intersected by axial grooves which are engaged by co-operating feet on individual members. Each member has a groove in its foot, which corresponds in profile to that of the rotor. A leaf spring, or spring loaded locking device lies in the peripheral groove and is urged flat by a tool so as to enable fitting of a member in an intersecting groove. On fitting of a member, the spring is released, to thereby arch or curve into the groove in the member's foot. The spring or device is long enough to span the groove in the foot of the member, and any tendency of the member to move axially of the engine, is prevented by interaction between the spring or device and extremities and the walls of the peripheral groove.

The arrangement of 1,514,724 is entirely unsuitable for use where the member includes a blade. There is no facility for the provision of tool insertion apertures and, consequently, no way of manipulating the spring device.

SUMMARY OF THE INVENTION

The present invention seeks to provide an improved bladed rotor.

The present invention provides a bladed rotor having an axis of rotation and comprising a plurality of blades mounted on the periphery of a rotor, said blades having feet which locate in axially arranged grooves in the rotor rim, said rotor rim having a peripheral groove formed therein, each blade foot having a groove in alignment with said peripheral groove, said foot grooves including opposing pads on their end faces and, for each blade, blade retention means comprising an abutment member residing in close sliding relationship within said rotor peripheral groove and having a peripheral length sufficient to span a said axial groove, and a projection which, on said abutment member being positioned so as to span a said axial groove, locates between a pair of said opposing pads to prevent significant movement of the associated blade in a direction axially of the rotor, by transferring axial loads generated by said blade to the sidewalls of the peripheral groove.

BRIEF DESCRIPTION OF THE DRAWINGS

The invention will now be described, by way of example and with reference to the accompanying drawing, which is an exploded part view of a bladed rotor incorporating the present invention.

DETAILED DESCRIPTION OF THE INVENTION

In the drawing, a rotor 10 of which only a portion of its rim is shown, and in the example is a fan rotor for a ducted fan gas turbine engine (not shown), has a plurality of dovetail grooves 12 formed in its rim, in known manner. The grooves 12 are provided for the receipt of the feet 14 of rotor blades 16, one blade foot 14 per groove 12. The grooves 12 are orientated so as to have their major dimension parallel with the axis of rotation of the rotor 10.

A further, peripheral groove 18 is formed in the rotor rim, and has a radial depth equal to that of the grooves 12.

Each blade foot 14 also has a groove 20 formed therein, and when each blade foot 14 is properly positioned in its respective groove 12, its groove 20 is aligned with the peripheral groove 18.

The side walls of each foot groove 20 are so formed as to define proud pads 22, one on each wall, in positional opposition to each other.

The blades 16 are fitted to the rotor 10 by sliding their feet 14 through the grooves 12, until their end extremities are flush with the relevant rotor faces. During operation of an engine (not shown) which includes the rotor of the present invention, rotational forces develop which cause each blade 16 to move radially outwards of the rotor 10 until the flanks of the feet 14 engage the flanks of the grooves 12. A gap 24 is thus formed between the bottoms of the grooves 23 and the undersides of the feet 14. The gap 24 extends for the full length of each foot, which also includes the radially inner end faces of each pad, and is utilised as follows: A plurality of arcuate strip members 26 are formed, equal in number to the number of blades 16 on the rotor 10. The radius of arc formed on their concave surface 28, corresponds with the radius of arc of the bottom of the peripheral groove 18, and the width of the strip portion of each member 26 is such as to make it a sliding fit in the peripheral groove 18 and each foot groove 20. The thickness of the strip portion of the member 26 is such that it will fit under each blade foot 14 when the blade 16 is in its operation loaded position, and its accurate length is such that, when positioned with its mid length centrally of the width of the respective groove 12, it spans the groove 12, its end extremities overlapping the side walls of the peripheral groove 18. Thus, when in the position just described, if the strip member 26 attempts to move longitudinally of its groove 12, its end extremities will abut one or other of the opposing sidewalls of the peripheral groove 18.

Each strip member 26 has a projection 30 formed about mid length, on its convex side. The projection 30 is proportioned such that when the member 26 is positioned as described hereinbefore, it lies in close spaced relationship with and between the opposing pads 22, and a slot 32 formed in its concave side, is aligned with an identically dimensioned slot 34 formed in the underside of each foot 14. A pin 36 is inserted through the slot 34 and slot 32, so as to restrain the member 26 against movement peripherally of the groove 18. The pin 36 may be retained therein by any suitable means (not shown).

The thickness of the projections 30 is less than the width of their associated strip portions, so that a land 38 is defined on each side of each projection 30. When the members 26 are in their operative positions, the lands 38 are located under the radially inner ends 40 of their associated pads 22, and the members 26 are thus restrained against undesirable movements radially outwardly of the rotor 10.

On reading this specification, the man skilled in the art will appreciate that, during operation of the aforementioned engine (not shown) any fluid loads experienced by the blades 16, which causes them to attempt to move along their respective grooves 12, will result in one or other of their pads 22 engaging the associated projection 30 and cause the associated members 26, via their end extremities, to engage a sidewall of the peripheral groove 18. The blade or blades 16 are thus restrained against further movement longitudinally of their grooves 12.

The member 26 may be designed as shown i.e. so that an individual member is provided for each blade 16. However, in such a case, each member will need its own pin 36. In an alternative design, a reduced number of increased length strips may be provided, each having a plurality of projections 30 thereon. Such a design using, for instance three equal length strips, which together would provide sufficient projections 30 for all of the blades 16 which are to be fitted to their rotor 10, would need only three pins 36 to restrain them against movement peripherally of the rotor.

I claim:

1. A bladed rotor having an axis of rotation and comprising a plurality of blades mounted on the periphery of said rotor, said blades having feet and said rotor having a rim, said blade feet being located in axially arranged grooves in said rotor rim, said rotor rim having a peripheral groove formed therein, each blade foot having a groove in alignment with said peripheral groove, said foot grooves including opposing pads on their faces and, for each blade, blade retention means comprising an abutment member residing in close sliding relationship within said rotor peripheral groove and having a peripheral length sufficient to span a said axial groove, and a projection which, on said abutment member being positioned so as to span a said axial groove, located between a pair of said opposing pads to prevent significant movement of the associated blade in a direction axially of the rotor, by transferring axial loads generated by said blade, to the side walls of the peripheral groove, said bladed rotor including pins, one for each abutment member and passing through aligned slots provided in the feet of the blades and abutment members in a direction axially of the rotor, so as to prevent movement of said abutment members from their operational positions, in directions peripherally of the groove in the rotor.

2. A bladed rotor as claimed in claim 1 wherein said projections are narrower than strips on which they are formed so as to provide lands which in situ, locate under the radially inner edges of respective said pads.

* * * * *